US006602212B1

(12) United States Patent
Ahn

(10) Patent No.: US 6,602,212 B1
(45) Date of Patent: Aug. 5, 2003

(54) FOOT MASSAGE APPARATUS

(75) Inventor: Boo-Hong Ahn, Gyungki-Do (KR)

(73) Assignee: Shin-Young Ahn, Seoul (KR)

( * ) Notice: Subject to any disclaimer, the term of this patent is extended or adjusted under 35 U.S.C. 154(b) by 0 days.

(21) Appl. No.: 09/914,762

(22) PCT Filed: Mar. 20, 2001

(86) PCT No.: PCT/KR01/00441

§ 371 (c)(1),
(2), (4) Date: Sep. 5, 2001

(87) PCT Pub. No.: WO02/074223

PCT Pub. Date: Sep. 26, 2002

(51) Int. Cl.[7] ..... A61H 9/00; A61H 1/00; A61H 33/04

(52) U.S. Cl. ..... 601/154; 601/27; 4/541.6

(58) Field of Search ..... 601/27, 28, 29, 601/76, 105, 154, 155, 156, 157, 158, 159; 4/492, 541.6, 541.3, 541.1, 541.4; 606/238

(56) References Cited

U.S. PATENT DOCUMENTS 3,837,334 A * 9/1974 Johnson ..... 601/19
3,965,495 A * 6/1976 McNair ..... 4/622
4,211,216 A * 7/1980 Burgess et al. ..... 4/541.4
4,485,503 A * 12/1984 Rolando et al. ..... 4/622
4,497,313 A * 2/1985 Kurosawa ..... 601/16
4,620,529 A 11/1986 Kurosawa
4,853,987 A * 8/1989 Jaworski ..... 4/509
5,161,265 A * 11/1992 Mikiya et al. ..... 239/448
6,210,349 B1 * 4/2001 Naruse et al. ..... 601/122
6,309,366 B1 10/2001 Maxwell

FOREIGN PATENT DOCUMENTS

JP 5-317380 12/1993
KR 97-73550 12/1997

* cited by examiner

*Primary Examiner*—Nicholas D. Lucchesi
*Assistant Examiner*—Fenn C Mathew
(74) *Attorney, Agent, or Firm*—Birch, Stewart, Kolasch & Birch, LLP

(57) ABSTRACT

In a foot massage apparatus, a foot massage apparatus which is capable of performing various massages such as an acupressure massage, a cold-water massage, a hot-water massage, a liquid medicine medicine, etc. efficiently by jetting water to feet includes a bottom jet means installed inside a main body, an intermittent jet head jetting water at the upper surface and bottom surface intermittently, a upper casing combined with a lower casing so as to be angle-adjustable, an acupressure roller installed at a center portion of a footstool, an aromatic agent jet means and a hot-air drying means, a heater in stalled between a detachable water vessel and a pump, and an input tube for depositing ice, salt, various medicines, etc. into the detachable water vessel installed at a lower casing of the main body.

12 Claims, 12 Drawing Sheets

FOOT MASSAGE APPARATUS

This application is the national phase under 35 U.S.C. § 371 of PCT International Application No. PCT/KR01/00441 which has an International filing date of Mar. 20, 2001, which designated the United States of America.

TECHNICAL FIELD

The present invention relates to a foot massage apparatus, and in particular to a foot massage apparatus which is capable of performing various massages such as an acupressure massage, a cold-water massage, a hot-water massage, a massage with medicine added, etc. effeciently by including a bottom surface jet means installed inside a main body, an intermittent jet head for intermittently jetting water toward the upper surface and bottom surface of a user's feet, an upper casing and a lower casing angle-adjustably coupled to each other, an acupressure roller installed at a center portion of a footstool, an aromatic agent jet means and a hot-air drying means, a heater installed between a detachable water vessel and a pump, and an input tube for depositing ice, salt, various medicines, etc. into the detachable water vessel installed at a lower casing of the main body.

BACKGROUND ART

Generally, a foot massage apparatus using air bubbles in an underwater state or a vibrator is widely known.

A foot massage apparatus using an air-bubble generator is convenient for using a liquid medicine but has little massage effect, and a foot massage apparatus using an electric vibrator is difficult to use for administering a liquid medicine and simply vibrates the feet of a user, and accordingly both foot massage apparatus can not have a massage effect by pressure such as a momentary impact or continuous impact.

DISCLOSURE OF THE INVENTION

Accordingly, it is an object of the present invention to provide a foot massage apparatus which is capable of improving a massage effect by impacting continuously or intermittently on the sole as well as the top side of the feet of a user by using water pressure, and selecting a liquid medicine massage or a cold-hot water massage as occasion demands.

It is another object of the preset invention to provide a foot massage apparatus which is capable of adjusting a combining angle of an upper casing coupled to a lower casing, and performing acupressure with water currents while also performing acupressure with an acupressure roller.

It is still another object of the present invention to provide a foot massage apparatus which is capable of jetting an aromatic agent during a massage by including an aromatic agent jetting means, and of drying the wet feet of the user efficiently after a massage by hot air from a hot-air drying means.

It is yet another object of the present invention to provide a foot massage apparatus which is capable of performing various massages such as an acupressure massage with an acupressure roller, a cold-hot water massage, a salt massage, a liquid medicine massage, etc. efficiently by means of a heater installed between a detachable water vessel and a pump and an input tube installed at a certain side of a main body in order to inject ice, salt and various liquid medicines into the detachable water vessel installed at the lower casing of the main body.

It is further another object of the present invention to provide a foot massage apparatus which is capable of improving an acupressure effect by performing acupressure with a plurality of acupressure rods intermittently by using air pressure.

In order to achieve the above-mentioned objects of the present invention, there is provided a foot massage apparatus including an upper casing, a lower casing and an openable casing cover. Accordingly, it is possible to clean every nook and corner of the foot massage apparatus by opening the casing cover.

A fixation contact rubber for fixing an ankle of a user is installed at the casing cover in order to dam up jets of water. The fixation contact rubber has a flexibility and elasticity, is soft to the touch by utilizing a contact portion and a pleat portion in design and is suitable for all sizes of ankle. A limit switch operated by a movable contact rubber is installed at the casing cover so as to prevent the water from leaking outwardly due to a wrong operation.

In addition, because a pair of rubber lids shutting a pair of foot insertion holes of the casing cover is included in the foot massage apparatus, it is possible to shut the pair of foot insertion holes in cleaning of the foot massage apparatus using jet-water, and it is also possible to protect the foot massage apparatus from dust penetrating into the main body by putting a pair of rubber lids on the foot massage apparatus when the foot massage apparatus is in safekeeping or not in use for a long time.

The foot massage apparatus includes jet heads each having a jet nozzle and separately installed at the front side, the rear side and the lower side of a main body. The jet nozzle of each jet head is formed not as a shower type but with three holes in order to jet water very strongly. Water currents jetted from the three jet nozzles jetting water are shut and opened by turns in accordance with the rotation of an impeller installed inside the jet head in an intermittent effect, whereby the intermitted water currents are jetted to the feet, and accordingly a massage effect can be maximized by beating and stimulating the feet.

The jet heads are installed at about 40 spots in order to jet the strongest water current with the same water pressure. Three nozzles are formed at each jet head, and the total of 120 water currents massage the feet efficiently by beating the whole feet strongly and intermittently. Accordingly the massage effect can be maximized in a very short time.

A plurality of cylinder-shaped recesses are formed within a pair of virtual foot installation regions at the bottom surface of the upper casing. An intermittent jet head is separately installed at each recess, and a pressure water supply pipe is connected to a pressure water chamber.

The intermittent jet head installed at each recess is placed along acupressure points of the feet (i.e., a passage for circulating energy and blood up and down and branches divided from the passage in a network, in order to circulate energy and blood to every nook and corner of a body) as in oriental medicine, and accordingly an acupressure massage effect can be added.

An intermittent acupressure means including an acupressure rod can be installed as occasion demands in order to perform acupressure with the acupressure rod being protruded intermittently. When a plurality of acupressure rods are protruded intermittently by air pressure, the acupressure effect can be doubled.

A footstool fabricated with a metal net for putting the feet thereon comfortably is installed at a position at a distance of 100~150 mm from the jet nozzle of the front jet means where the effect of the water pressure is maximized, and an acupressure roller is installed at the center of the footstool. An input tube is installed at the side of the main body, and ice, salt, various medicines, etc. injected into the input tube dissolve in the water of the detachable water vessel installed at the lower casing of the main body. Accordingly, acupressure with the acupressure roller, various massages such as a cool/hot water massage, a salt massage, a medicine massage, etc. can be performed.

Because the inner bottom surface of the upper casing of the main body slopes upward, the strongly jetted water flows into the detachable water vessel at the lower casing of the main body through a drain outlet installed at the rear of the bottom surface, and then flows into the detachable water vessel after being filtered through a mesh screen combined with the drain outlet. Here, because the mesh screen is removable, it is easy to clean the mesh screen. As for the mesh screen, a carbon filter may be used to clean the used water.

In addition, because the detachable water vessel can be easily separated from the main body, it is easy to clean and there is no need to move the main body near to a water supplier. And as there are graduations on the water vessel, water can be easily and accurately filled into the detachable water vessel.

An ultraviolet lamp is installed at the upper portion of the detachable water vessel in order to sterilize the water inside the water vessel. Accordingly it is possible to perform a sanitary massage. When the user inserts the detachable water vessel into the lower portion of the main body, a discharge pipe of the detachable water vessel is connected with a water supply pipe of a pump, and a valve installed at the discharge pipe of the detachable water vessel is opened. When the user pulls the water vessel outwardly, the valve is shut.

Because a mesh screen is connected with the discharge pipe of the detachable water vessel, it is possible to perform a massage with clean water. When a double filtering arrangement is adopted by installing a mesh screen between the discharge pipe of the detachable water vessel and the water supply pipe of the pump, it is possible to perform a massage with cleaner water by which can be prevented more surely impurities from penetrating into a pump motor.

A heater is installed at the center portion of the pump in order to heat the water to a certain degree. The water temperature is adjusted by a precise temperature sensor sensing the water temperature and an electronic circuit. The heating means can be used safely by increasing a life span and decreasing a hazard such as an electric leakage, etc. by embedding the heater into a circular pipe (i.e., a cylinderical pipe is made of aluminum), and because the inner circumferential portion of the circular pipe which forms a passage for the water is formed with a concave-convex shape, the heating efficiency can be maximized.

The water supplied from the detachable water vessel flows into a pump after passing through the heating means, is directly delivered into the jet heads placed at the bottom surface, the front surface and the rear surface of the main body by a pumping force of the pump, flows into an inlet hole formed so as to be symmetric with respect to the peripheral wall of the cylinder unit and rotates an impeller combined with each jet head. As the impeller of each jet head rotates by the pressure of the water, a shutter plate of the impeller periodically shuts/opens a nozzle hole formed in the nozzle cover of each jet head. Accordingly, the feet can be massaged by the water jetted intermittently and strongly. The water does not flow through small pipes individually but flows a minimum quantity through a pressure water chamber with only passage of water divided into a bottom jet means, a front jet means and a rear jet means, whereby a water current is jetted stronger by increasing a pressure of the water and maintains the same water pressure in each nozzle by directly connecting each nozzle to the minimum quantity of the pressure water chambers.

Because the rear portion of the lower casing is hinge-combined with the upper casing, the front portion of the upper casing can be lifted by being separated from the lower casing, whereby the user can use the foot massage apparatus at the easiest angle by adjusting the angle of the upper casing at a certain degree for the convenience of the user.

An aromatic agent jet means is combined with the casing cover. Accordingly it is possible to jet an aromatic agent inside the main body during the massage.

A hot air drying means in installed inside the main body. Accordingly, it is possible to dry the feet easily after the massage.

And, in order to perform the above-mentioned functions, an operation panel controlling various functions and including switches such as a power switch, a water pressure switch adjusting a water pressure as a high pressure or a low pressure, a temperature adjusting switch adjusting a water temperature as a low, a medium or a high temperature, an ultraviolet sterilization lamp switch turning on/off an ultraviolet sterilization lamp and a dryer switch operating a dryer, etc. is installed at the front upper surface of the main body in the easiest position to operate the foot massage apparatus for a user, and all the above-mentioned functions are controlled by an electronic circuit.

BEST MODES FOR CARRYING OUT THE PREFERRED EMBODIMENTS

The preferred embodiments of the present invention will now be described with reference to the accompanying drawings.

Figure 1:
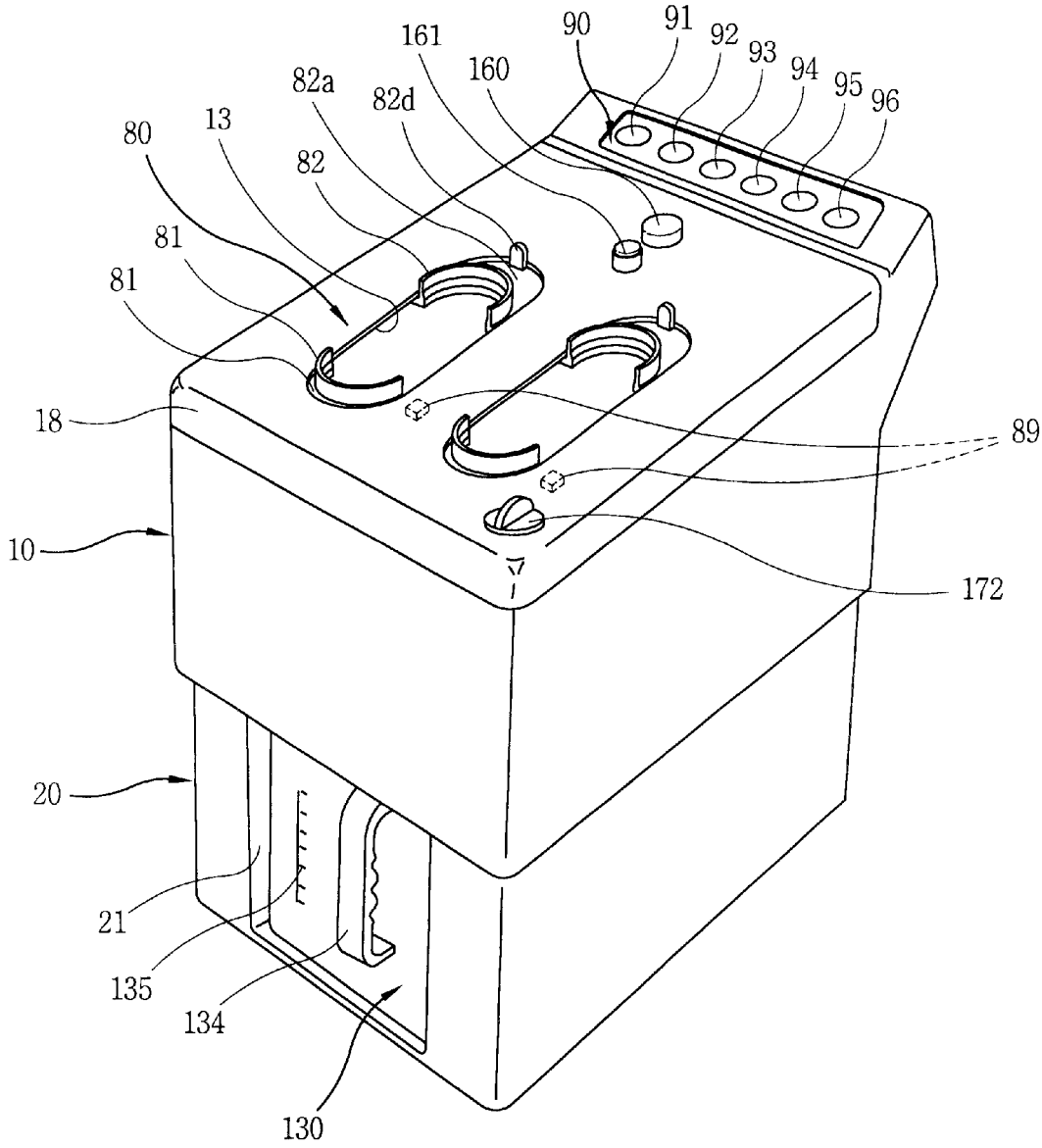
FIG. 1 is a perspective view illustrating a foot massage apparatus in accordance with an embodiment of the present invention.
Figure 2:
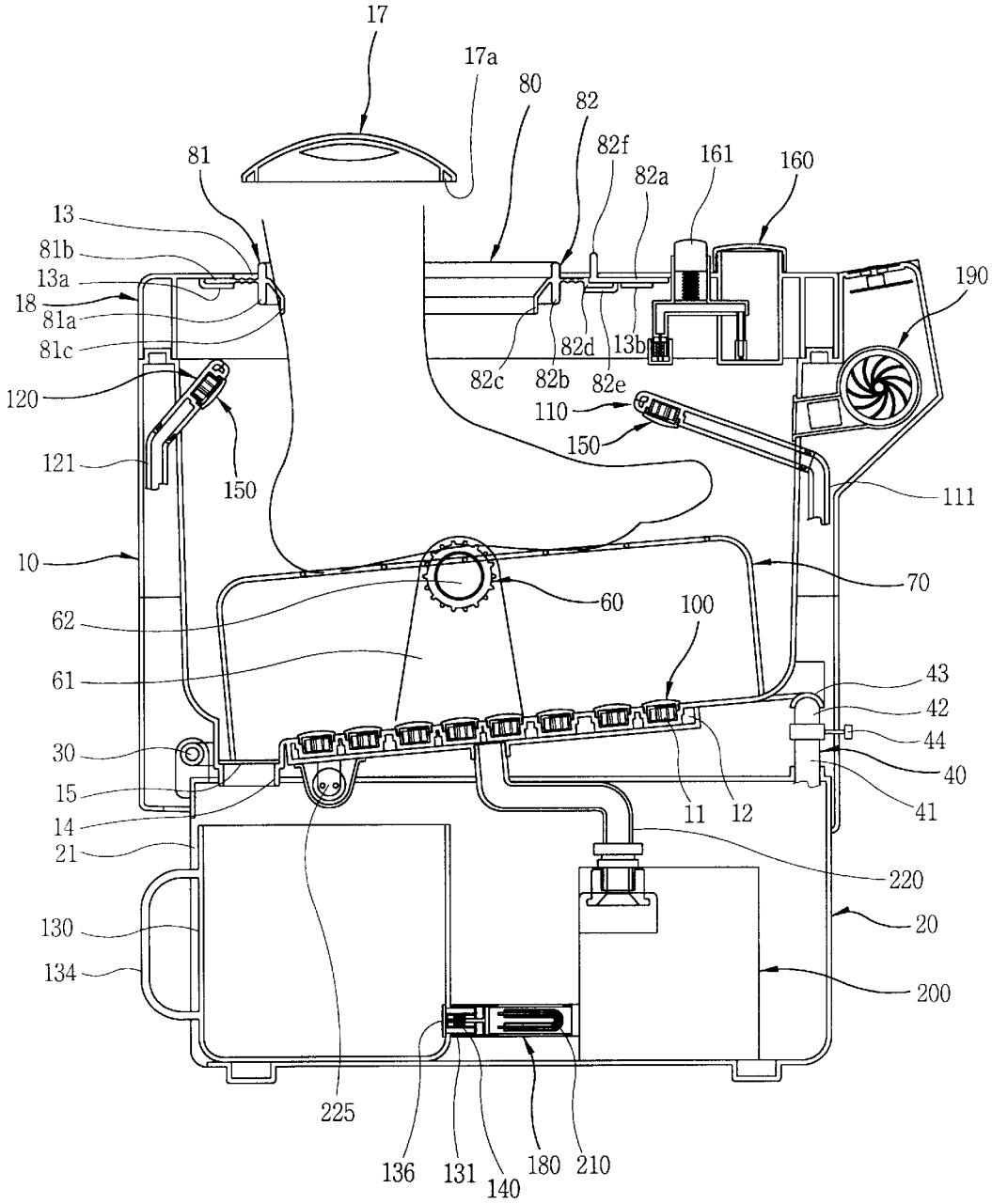
FIG. 2 is a vertical cross-sectional view illustrating the foot massage apparatus in accordance with the embodiment of the present invention.
Figure 3:
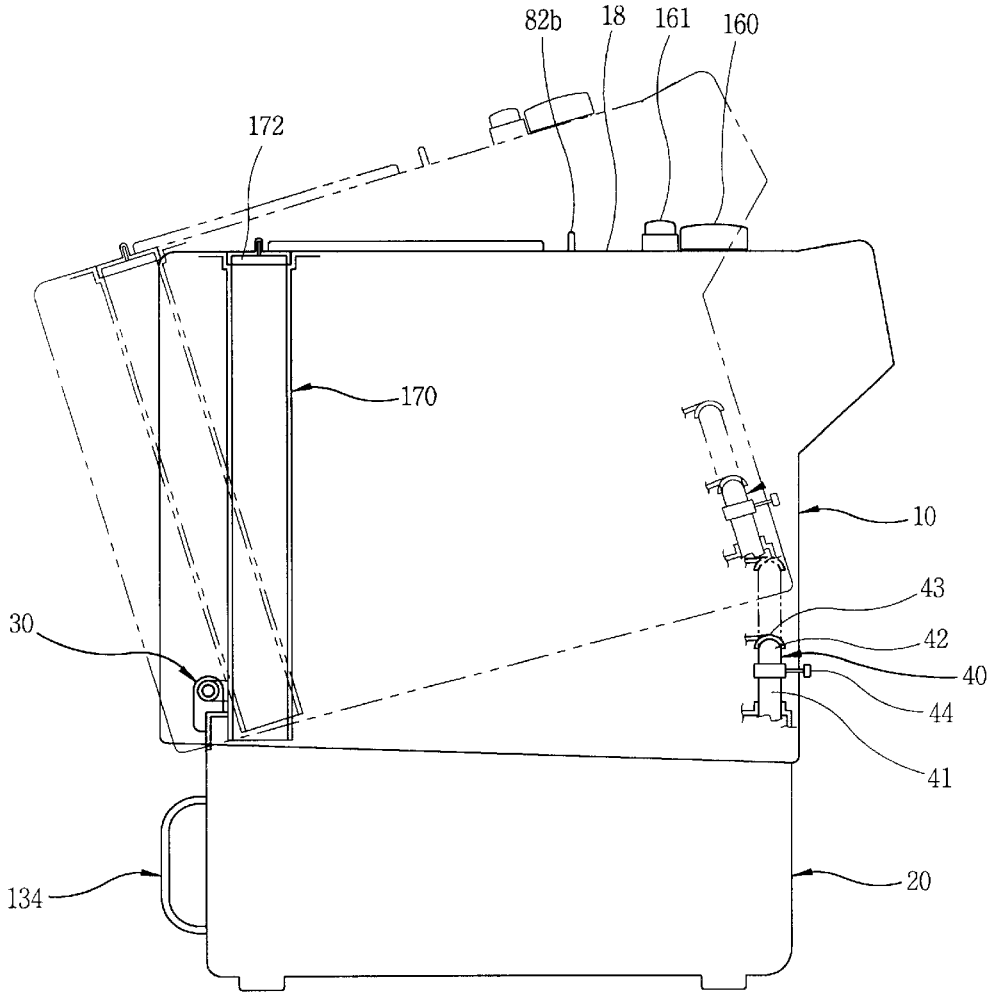
FIG. 3 is a side view illustrating the foot massage apparatus in accordance with the embodiment of the present invention.
Figure 4:
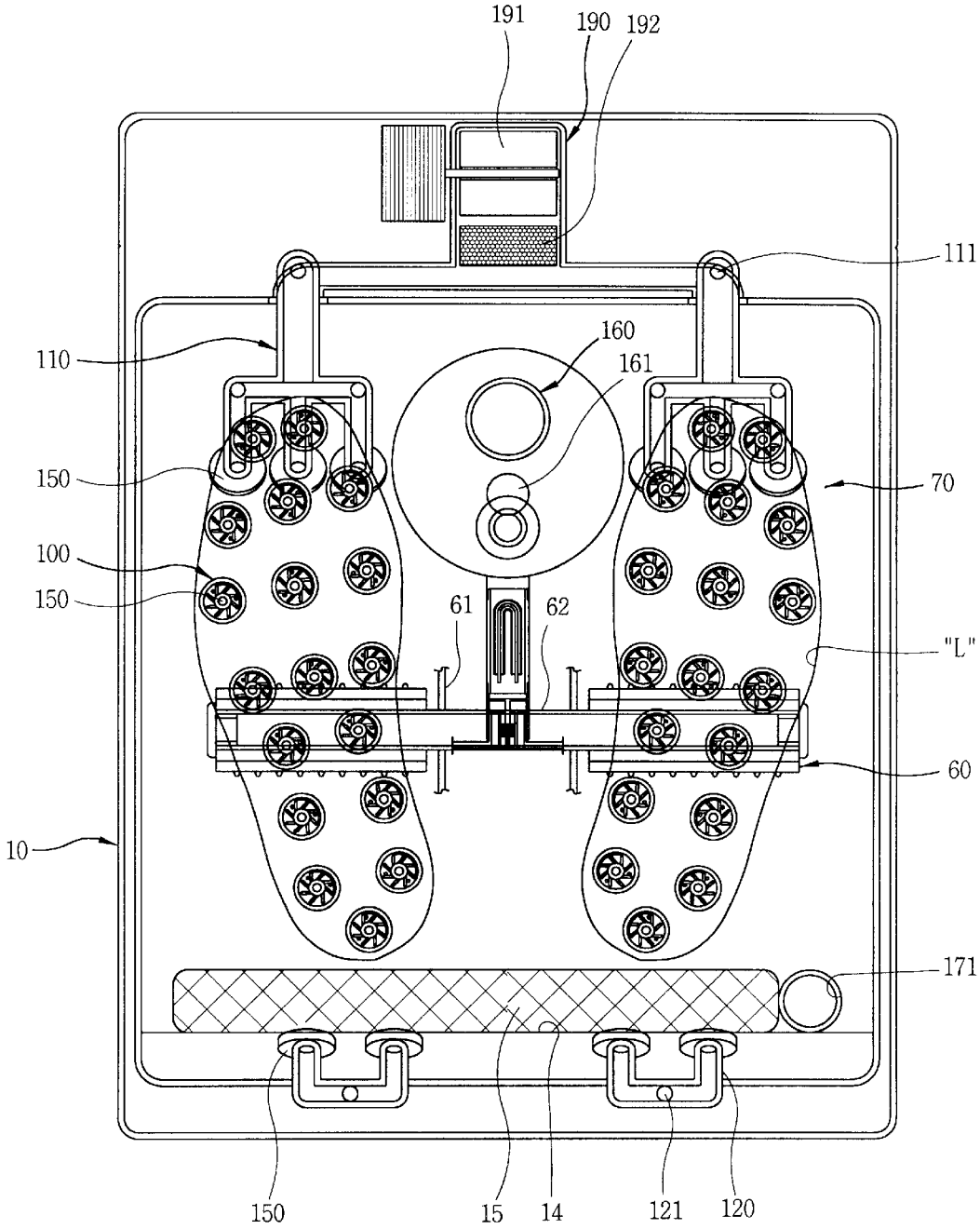
FIG. 4 is a horizontal cross-sectional view illustrating the foot massage apparatus in accordance with the embodiment of the present invention.

FIGS. 1~10 illustrate a foot massage apparatus in accordance with a first embodiment of the present invention, in which FIG. 1 is a perspective view illustrating a foot massage apparatus in accordance with the embodiment of the present invention, FIG. 2 is a vertical cross-sectional view illustrating a foot massage apparatus in accordance with the embodiment of the present invention, FIG. 3 is a side view illustrating the foot massage apparatus in accordance with the embodiment of the present invention, and FIG. 4 is a horizontal cross-sectional view illustrating the foot massage apparatus in accordance with the embodiment of the present invention.

As depicted in FIGS. 1~4, in a foot massage apparatus in accordance with the present invention, an upper casing 10 is connected with a lower casing 20 so as to be movable by a hinge 30 installed at the side of the upper and lower casings 10, 20 in order to combine the upper and lower casings 10, 20, and an angle adjusting means 40 adjusting an angle of the upper casing 10 is placed on the other side of the upper and lower casings 10, 20.

A bottom jet means 100 is installed at the bottom surface of the upper casing 10, a front jet means 110 is installed at the front upper portion of the upper casing 10, and a rear jet means 120 is installed at the rear upper portion of the upper casing 10. Each jet means 100, 110, 120 includes an intermittent jet head 150 in order to jet water intermittently to feet of a user.

The bottom jet means 100 includes a plurality of cylinder-shaped recesses 11 formed at the bottom surface of the inner casing 10, a plurality of intermittent jet heads 150 separately formed at the plurality of cylinder-shaped recesses 11 and a pressure water supply pipe 220 connected to a pressure water chamber 12.

The plurality of intermittent jet heads 150 of the bottom jet means 100 can be partially or generally placed along acupressure points of feet (i.e., a passage for circulating energy and blood up and down and branches divided from the passage in a network in order to circulate energy and blood every nook and corner) as known in oriental medicine.

The front jet means 110 and rear jet means 120 are connected to the pressure water supply pipe 220.

It is advisable to use a flexible hose as the pressure water supply pipe 220 so as to be flexible in adjusting of the angle of the upper casing 10.

Figure 10A:
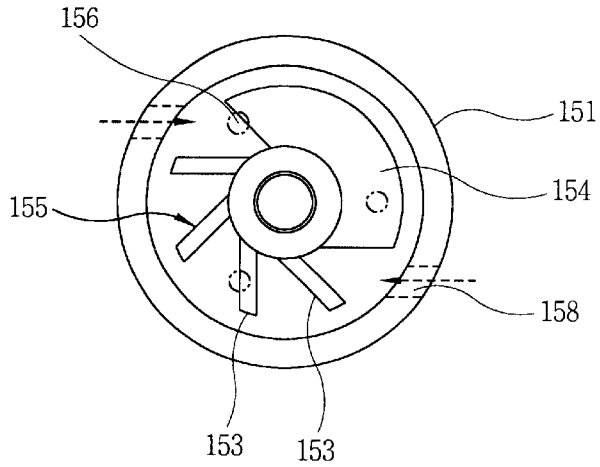
FIG. 10A is a plan view illustrating a jet head in accordance with embodiment of the present invention.
Figure 10B:
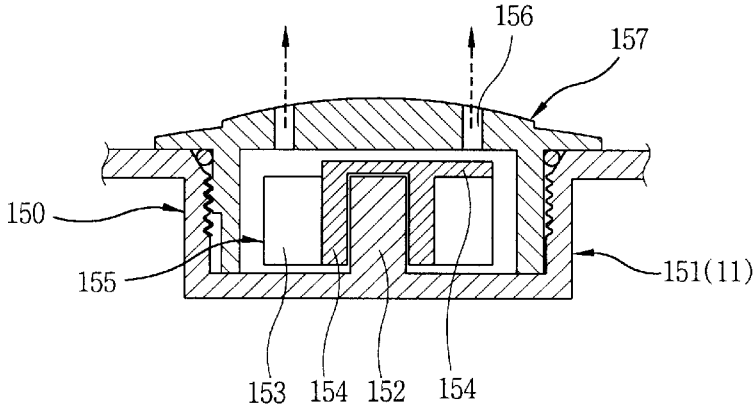
FIG. 10B is a vertical cross-sectional view illustrating the jet head in accordance with the embodiment of the present invention.
Figure 10C:
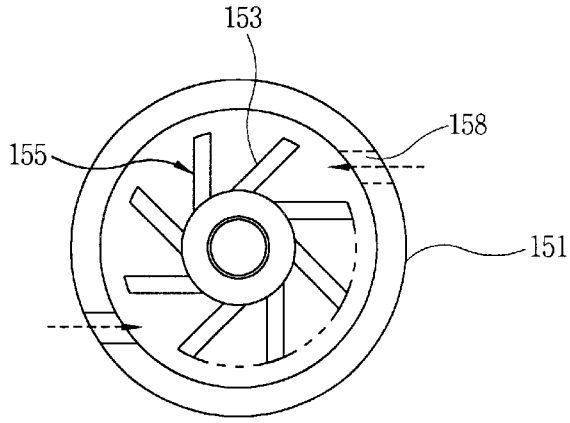
FIG. 10C is a plan view illustrating the jet head in accordance with the embodiment of the present invention.

As depicted in FIGS. 10A~10C, each intermittent jet head 150 includes an axial protrusion 152 formed at the center portion, a cylinder unit 151 having a pair of inlet holes 158 formed at a peripheral wall in order to pass pressurized water, a plurality of blades 153 formed at the outer circumference of a hub 154 in a vortex shape, a shutter plate 154 formed at the upper portion and covering part of the plurality of blades 153, an impeller 155 installed on the axial protrusion 152 of the cylinder unit 151, and a nozzle cover 157 combined with the cylinder unit 151 by a screw thread and having a plurality of nozzles 156 (three nozzles are depicted in the drawings). The pressurized water flowing into the inlet hole 158 of the cylinder unit 151 is intermittently discharged through the plurality of nozzles 156 in the nozzle cover 157 in accordance with rotation of the impeller 155 automatically opening/closing the plurality of nozzles 156.

The plurality of cylinder-shaped recesses 11 formed at the bottom surface of the upper casing 10 perform the function of the cylinder unit 151 of the intermittent jet head 150 of the front and the rear jet means 110, 120; however, the cylinder unit 151 of the intermittent jet head 150 can be formed separately, and in this case the intermittent jet head 150 can be a separate assembly unit including the cylinder unit 151, the impeller 155 and the nozzle cover 157.

A pair of roller supporting plates 61 are formed at the bottom center portion of the upper casing 10. An axial bar 62 is fixed to the roller supporting plate 61, and an acupressure roller 60 is separately combined at the both ends of the axial bar 62. Accordingly, the user can get acupressure by putting their feet on the acupressure roller 60 and rolling the acupressure roller 60.

A footstool 70 is installed inside the upper casing 10 so as to beat a distance from the bottom jet means 100. A drain-outlet 14 draining the water discharged from the bottom, front, rear jet means 100, 110, 120 is formed in the inner bottom surface of the upper casing 10 in a horizontal direction, and a screening net 15 for filtering impurities is connected to the end of the drain-outlet 14.

A hot-air drying means 190 for drying the feet with hot air and an aromatic agent jet means 160 are separately formed in the upper portion of the upper casing 10. A pair of foot insertion holes 13 for inserting feet are formed in the center portion of the upper surface plate of a casing cover 18 covering the upper casing 10, and a foot insertion hole sealing means 80 is combined with each foot insertion hole 13. And an operation panel 90 (not shown) is installed at the front end of the upper casing 10.

The angle adjusting means 40 includes a fixation pipe 41 fixed to the front end portion of an upper plate of the lower casing 20, an adjusting rod 42 inserted inside the fixation pipe with a spring (not shown) and having a hemispherically shaped upper end, a seat unit 43 formed at the bottom front end of the upper casing 10 and contact-supporting the adjusting rod 42 and a set screw 44 combined with the upper end of the fixation pipe 41.

As depicted in FIGS. 1 and 2, the foot insertion hole sealing means 80 includes a fixation contact rubber 81 formed at the rear of each foot insertion hole 13 in a long oval shape on the upper surface plate of the casing cover 18, and a movable contact rubber 82 formed at the front portion of each foot insertion hole 13 so as to be slide-movable.

The fixation contact rubber 81 includes a contact portion 81*c* formed at the inner circumference of an oval rib 81*a* and a fixation portion 81*b* formed at the outer circumference of the oval rib 81*a* and fixed at the side of each foot insertion hole 13 by inserting the fixation portion 81*b* into a fitting unit 13*a* formed at the back surface of the upper surface plate of the casing cover 18. The movable contact rubber 82 includes an oval fitting unit 82*e* at a side of a plate 82*a* (i.e., the plate 82*a* is made of plastic) installed at the upper surface and having a handle 82*f*, a contact portion 82*c* formed at the inner circumference of an oval rib 82*b* (i.e., the oval rib 82*b* is made of rubber) and a fixation portion 82*d* formed at the outer circumference of the oval rib 82*b* and fixed by inserting the fixation portion 82*d* into the fitting unit 82*e*, and a guide 13*b* formed at the back surface of the upper surface plate of the casing cover 18 in order to guide the plate 82*a* so as to be slide-movable.

A limit switch 89 is installed at the underside of the upper surface plate of the casing cover 18 and is turned on when the movable contact rubber 82 is slid into proximity to contact rubber 81, and is contacted to an ankle of a user, the foot massage apparatus can operate when the limit switch 89 is turned on in order to prevent water from leaking outwardly before movable contact rubbers 82 engage the user's ankles.

The operation panel 90 includes a power switch 91, a timer switch 92, a water pressure adjusting switch 93, a heater switch 94, an ultraviolet sterilization lamp switch 95, and a dry switch 96, etc.

A pair of rubber lids 17 covering the foot massage apparatus when not in use are separately connectable with the pair of foot insertion holes 13 formed at the upper surface plate of the upper casing cover 18, and a fitting groove 17*a* which engages the oval ribs 81*a*, 82*b* of the fixation contact rubber 81 and the movable contact rubber 82 is separately formed in the pair of rubber lids 17.

Figure 6:
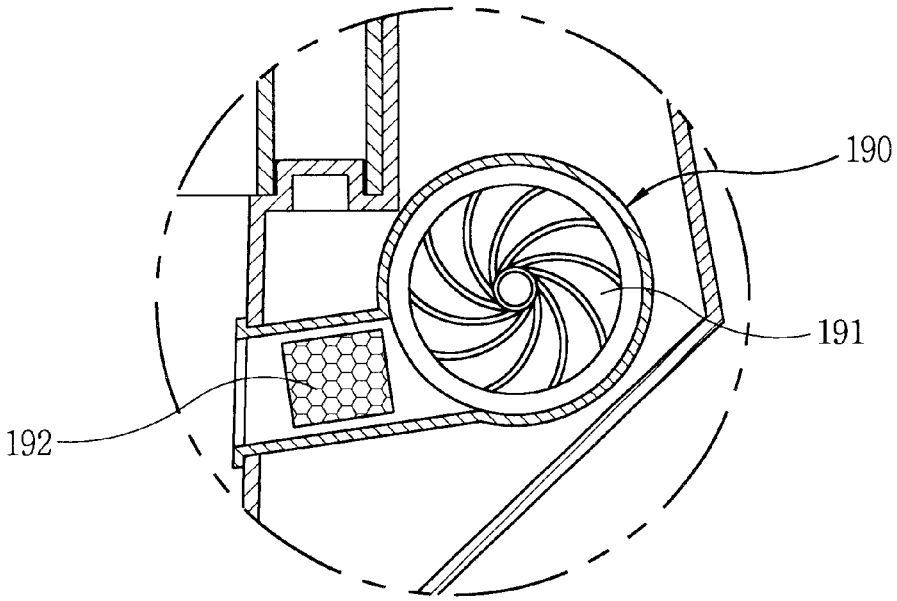
FIG. 6 is a vertical cross-sectional view illustrating an aromatic agent jet means in accordance with the embodiment of the present invention.

As depicted in FIG. 6, the hot-air drying means 190 includes a blower 191 combined with the upper side of the upper casing 10 and a ceramic heater 192 which radiates far infrared combined with the front of a draft trunk.

Figure 5:
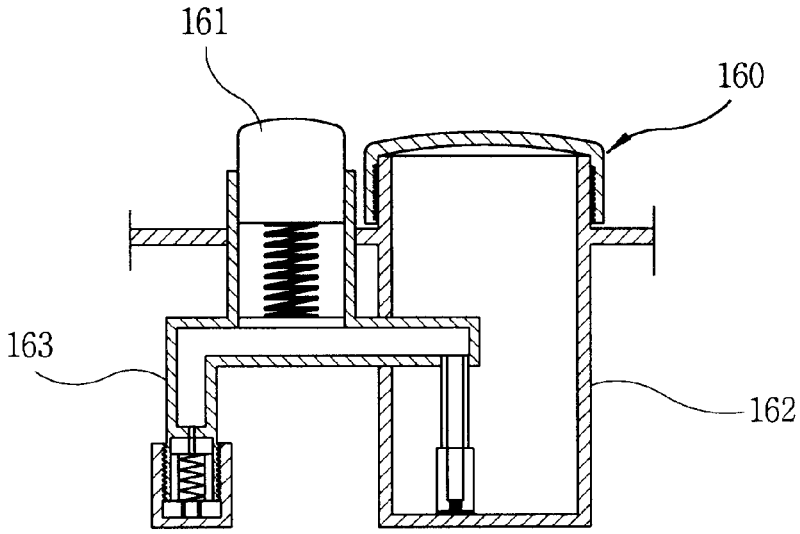
FIG. 5 is a vertical cross-sectional view illustrating a hot air drying means in accordance with the embodiment of the present invention.

As depicted in FIG. 5, a general spray type aromatic agent injector which jets an aromatic agent through a jet unit 163 by pushing an aromatic agent input button 161 after filing an aromatic agent reservoir 162 with liquid aromatic agent can be used as the aromatic agent jet means 160.

As depicted in FIG. 2, a pump 200 is fixed inside the lower casing 20, a water supply pipe 210 is connected to the lower side portion of the pump 200, and a pressurized water supply pipe 220 is connected with the upper side portion of the pump 100. A switch valve 140 is fixed inside the discharge pipe 131 formed at the lower portion of the detachable water vessel 130 insertable through the opening 21 formed at the rear of the lower casing 20, and a mesh screen 136 is connected with the inner end portion of the discharge pipe 131.

The detachable water vessel 130 can be made of transparent plastic, etc., and has a handle 134 and graduations 135 displaying a water level.

Figure 7A:
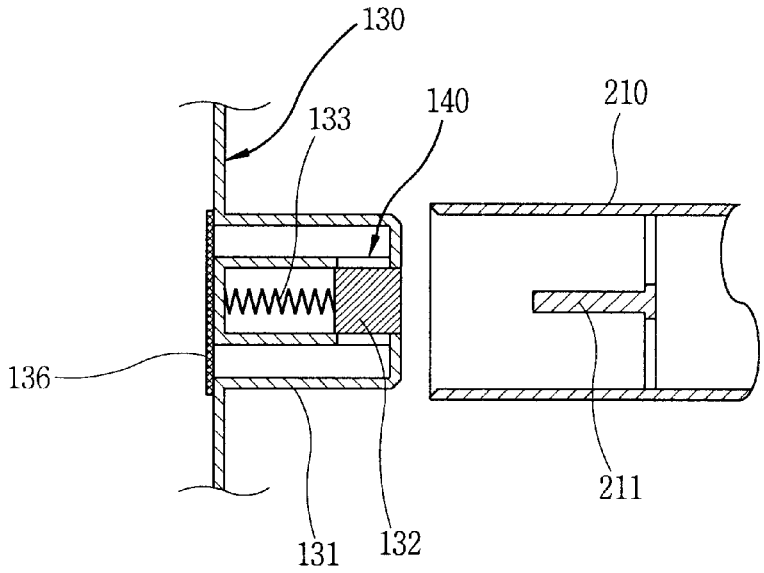
FIG. 7A is a vertical cross-sectional view illustrating a water tank outlet valve in accordance with the embodiment of the present invention.
Figure 7B:
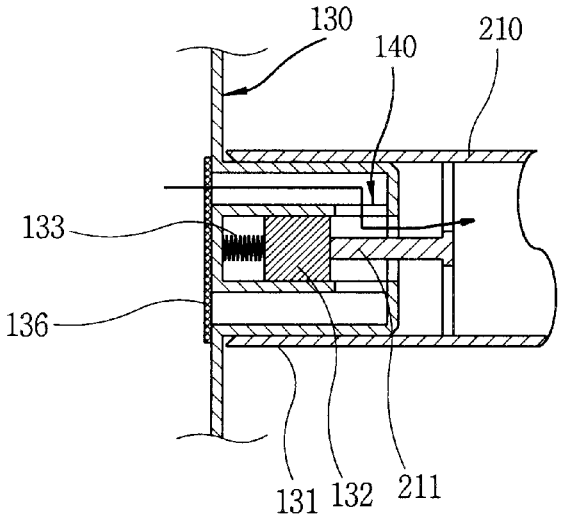
FIG. 7B is a vertical cross-sectional view illustrating a switch valve of a water vessel in accordance with the embodiment of the present invention.

As depicted in FIGS. 7A and 7B, when the discharge pipe 131 of the detachable water vessel 130 is inserted into the water supply pipe 210 of the pump 200, a valve body 132 and a spring 133 combined with the discharge pipe 131 are pressed by a protrusion pin 211 of the water supply pipe 210, and accordingly a water passage is opened. The heating means 180 for heating supplied water is combined with the water supply pipe 210.

Figure 8A:
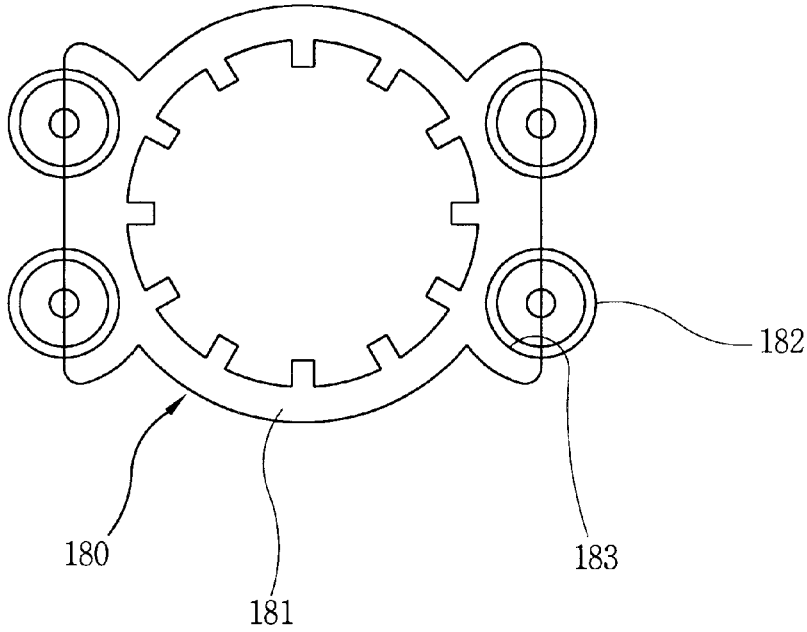
FIG. 8A is a plan view illustrating a heater in accordance with embodiment of the present invention.
Figure 8B:
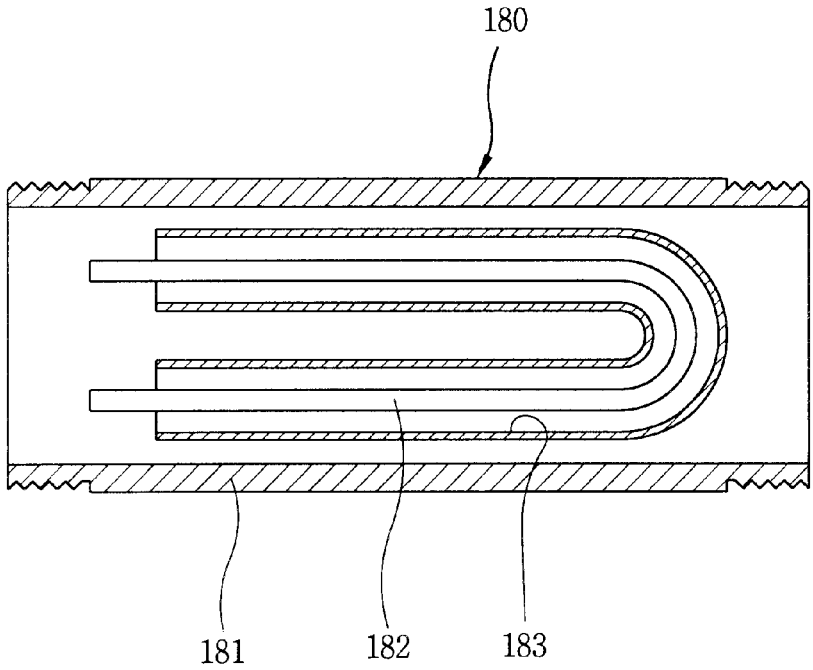
FIG. 8B is a vertical cross-sectional view illustrating the heater in accordance with the embodiment of the present invention.

As depicted in FIGS. 8A and 8B, a plurality of heaters 182 are combined with the peripheral wall of a circular pipe 181 (i.e., the circular pipe 181 is made of aluminum). The inner circumference of the circular pipe 181 is formed in a concave-convex type. A connecting member 183 connecting a heater 182 to the circular pipe 181 is formed at the outer circumference of the circular pipe 181, and a screw thread (not shown) is formed at the both ends of the circular pipe 181 in order to connect the circular pipe 181 to the water supply pipe 210 and the discharge pipe 131.

In addition, as depicted in FIGS. 3 and 4, an input tube 170 for dispersing medicine or ice, etc. into the detachable water vessel 130 is combined at a certain side of the upper casing 10, an outlet 171 is formed at the bottom surface of the input tube 170 in order to discharge the medicine or ice, etc. into the detachable water vessel 130, and a lid 172 is combined with the upper end of the input tube 170 at the upper surface plate of the casing cover 18. In addition, an ultraviolet sterilization lamp 225 is disposed at a lower side of the upper casing 10.

Figure 9:
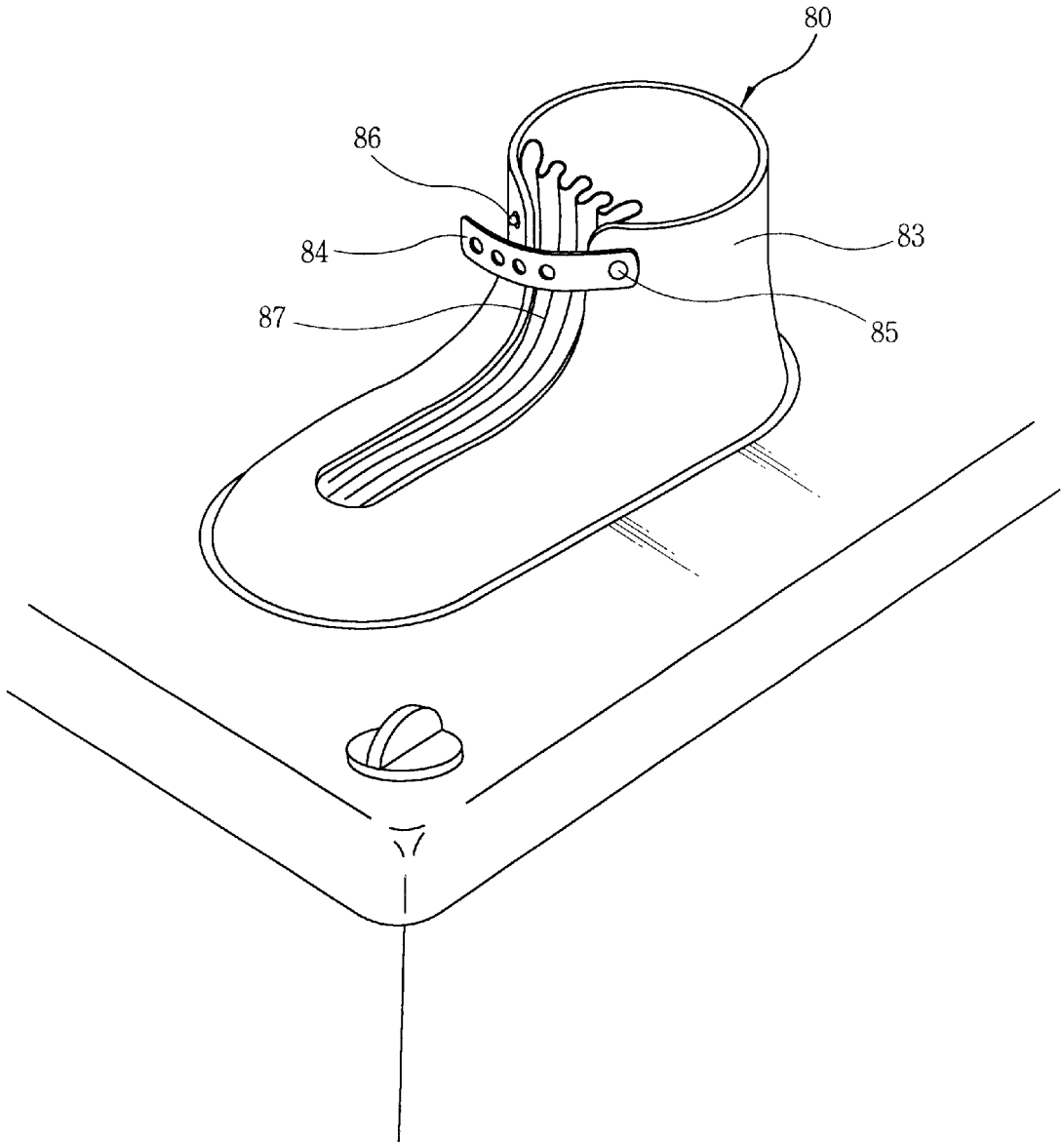
FIG. 9 is a perspective view illustrating a foot insertion hole sealing means in accordance with the embodiment of the present invention.

FIG. 9 is a perspective view illustrating another type of the foot insertion hole sealing means 80. As depicted in FIG. 9, a foot contact unit 83 is fixed to each foot insertion hole 13 formed in the upper surface of the casing cover 18. A pleated member 87 is installed at the inner ends of the foot contact unit 83. The end of a fixation band 84 having a plurality of fixation holes is fixed to the outer end of the foot contact unit 83 by a fixation member 85. A fixation protrusion 86 is formed at the other outer end of the foot contact unit 83 and is insertable into one of the plurality of fixation holes of the fixation band 84. The foot contact unit 83 has a shape the same as the upper structure of a shoe.

Figure 11:
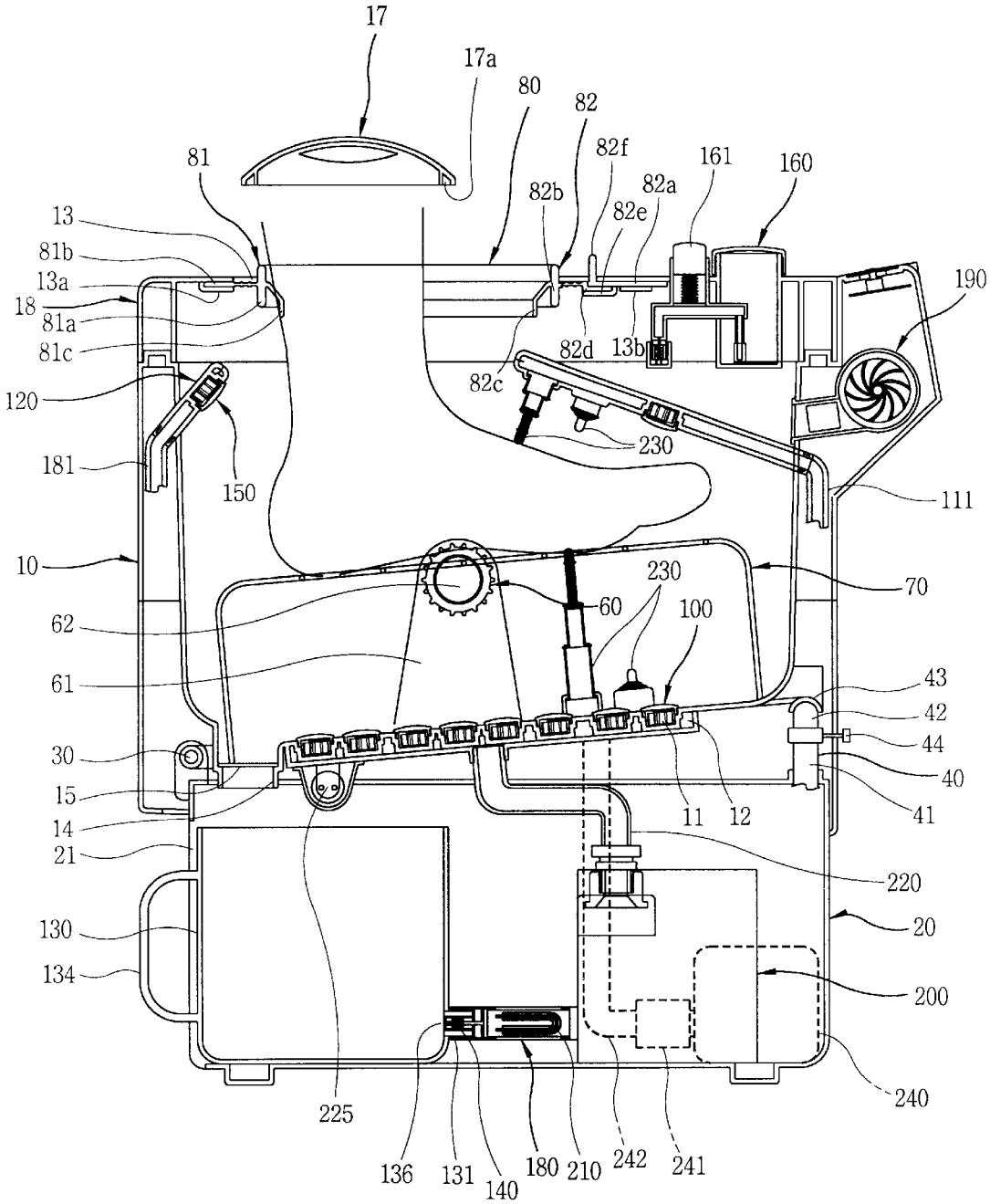
FIG. 11 is a vertical cross-sectional view illustrating a foot massage apparatus in accordance with another embodiment of the present invention.
Figure 12:
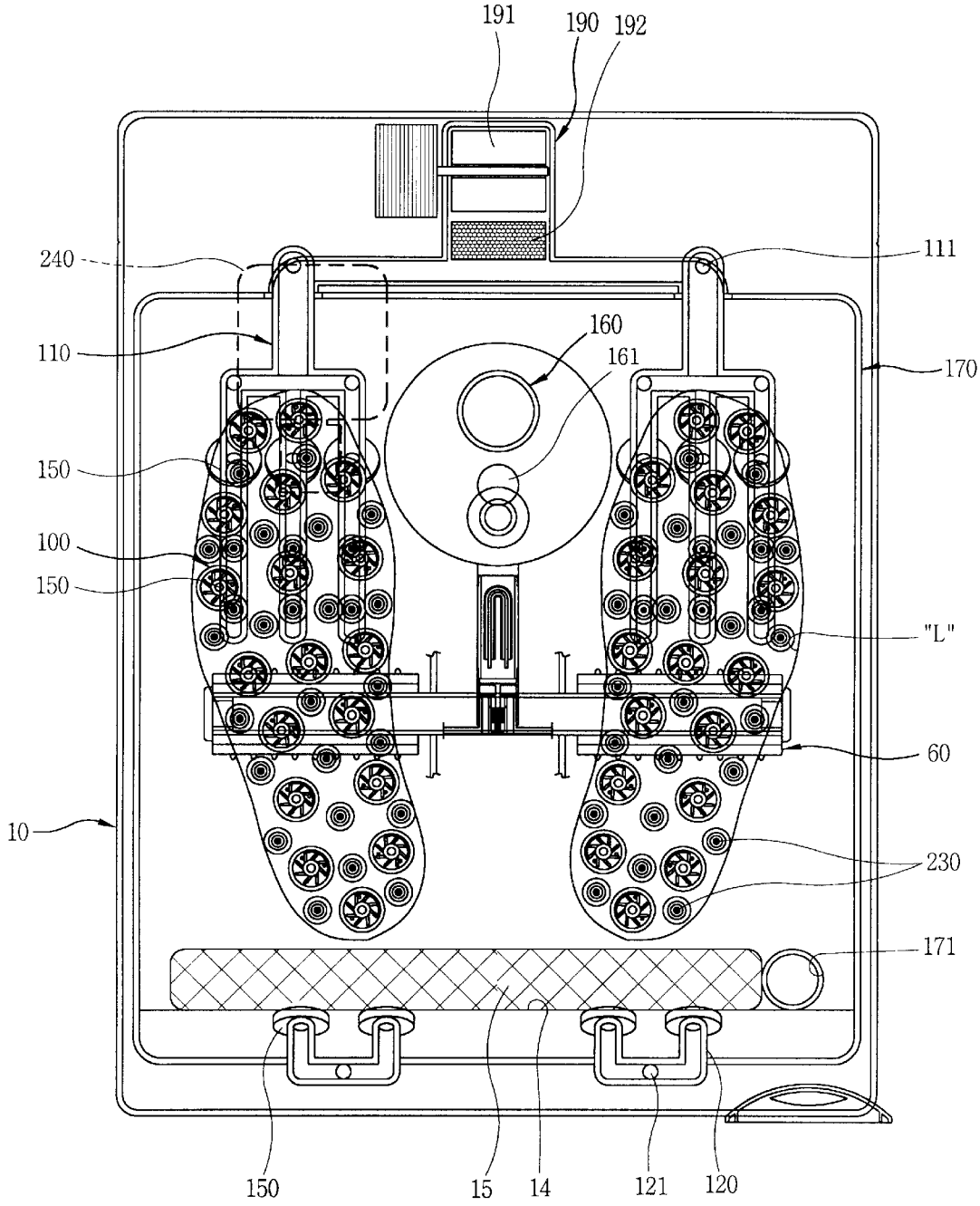
FIG. 12 is a horizontal cross-sectional view illustrating the foot massage apparatus in accordance with the other embodiment of the present invention.
Figure 13A:
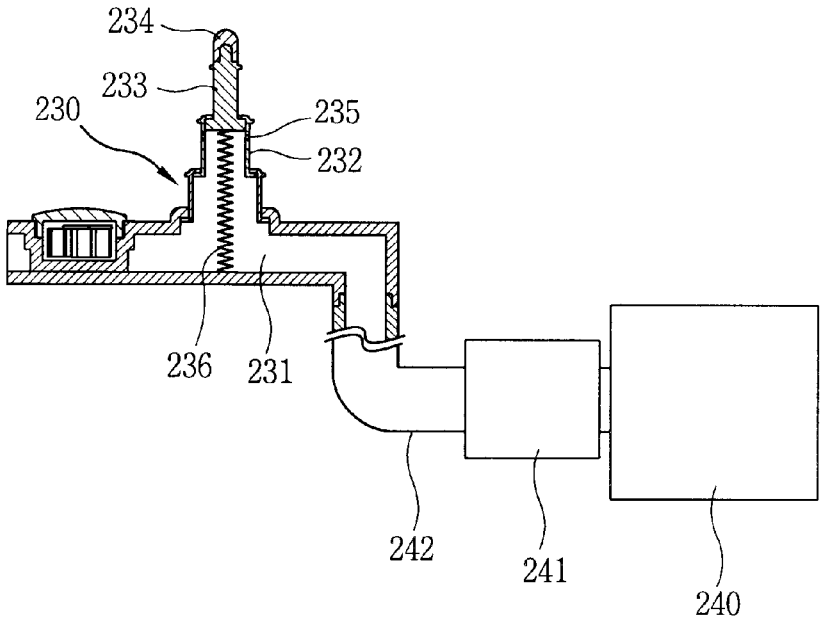
FIGS. 13A and 13B are vertical cross-sectional views illustrating an acupressure rod in accordance with the other embodiment of the present invention.
Figure 13B:
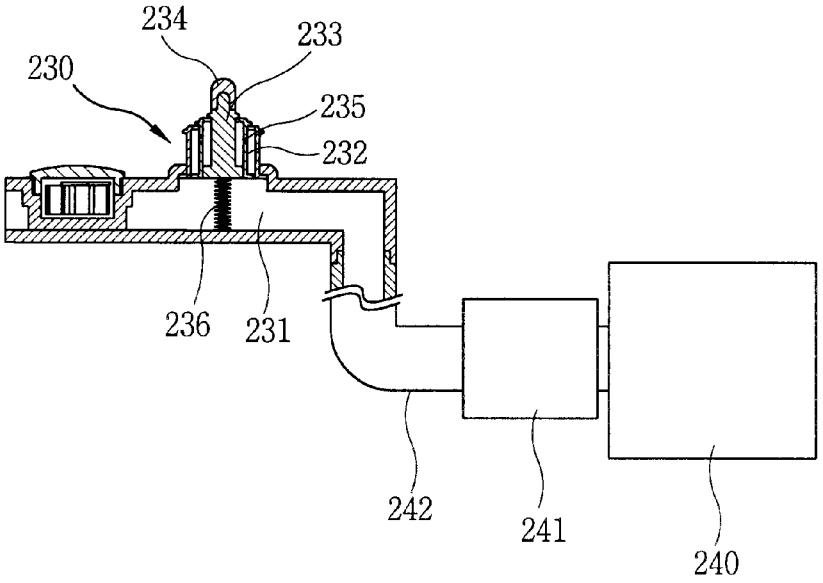

FIGS. 11~13 illustrate a foot massage apparatus in accordance with another embodiment of the present invention. FIG. 11 is a vertical cross-sectional view illustrating the foot massage apparatus in accordance with another embodiment of the present invention, FIG. 12 is a horizontal cross-sectional view illustrating the foot massage apparatus in accordance with the other embodiment of the present invention, and FIGS. 13A and 13B are vertical cross-sectional views illustrating an acupressure rod in accordance with the other embodiment of the present invention.

In the foot massage apparatus in accordance with the other embodiment of the present invention, the intermittent jet head 150 is separately combined with the lower jet means 100 and the front jet means 110, and an intermittent acupressure means 230 for performing acupressure by intermittently using an acupressure rod 233 installed.

The intermittent acupressure means 230 is generally placed at a pair of virtual foot installation regions having a sole shape of the foot by being installed at the lower jet means 100, and the intermittent acupressure means 230 of the front jet means 110 is placed so as to be adjacent to the intermittent jet head 150 of the jet pipe 121.

In the intermittent acupressure means 230, a multistage telescoping tube 232 and the acupressure rod 233 are connected with a circular open portion of a pressure passage 231. A rubber cap 234 is connected to the upper end portion of the acupressure rod 233, and an intermittent value 241 such as a solenoid valve for intermitting the flow of an intermittent pressure means 240 such as an air compressor is installed in the pressure passage 231 and is connected to the intermittent acupressure means 230 through a pipe 242.

The multistage telescoping tube 232 includes a lower pipe connected with the pressure passage 231 and an upper pipe connected with the acupressure rod 233, and an outlet 235 is formed at the upper pipe.

The intermittent acupressure means 230 can be installed at the rear jet means 120. The position and number of the intermittent acupressure means 230 can be changed.

The operation of the foot massage apparatus in accordance with the present invention will now be described.

In order to use the foot massage apparatus in accordance with the present invention, water is filled into the detachable water vessel 130 to a certain level, and the detachable water vessel 130 is inserted into the lower casing 20 through the opening 21 formed in the lower casing 20. The discharge pipe 131 of the detachable water vessel 130 is inserted into the water supply pipe 210 of the pump 200 and the switch valve 140 connected with the discharge pipe 131 is opened by being pushed by the protrusion pin 211 of the water supply pipe 210.

In addition, the angle of the upper casing 10 can be adjusted in accordance with a user's desire with the angle adjusting means 40 installed at the middle portion of the main body.

After that, the user opens the pair of rubber lids 17, inserts the feet through the pair of foot insertion holes 13 formed at the casing cover 18, puts the feet on the footstool 70 installed inside the upper casing 10, and slide-moves the movable contact rubber 82 of each foot insertion hole sealing means 80 with the handle 82*f* until each movable contact rubber 82 contacts to the foot.

Accordingly, the limit switch is turned on by the movable contact rubber 82, and thus the foot massage apparatus operates.

After that, the water from the detachable water vessel 130 is filtered by passing through the mesh screen 136 of the discharge pipe 131 of the detachable water vessel 130 by a pumping force of the pump 200, is sterilized by the ultraviolet sterilization lamp 225, flows into the water supply pipe 210 of the pipe 200, is pumped into the pressure water chamber 12 of the lower jet means 100 installed inside the upper casing 10 and the jet pipes 111, 121 of the front and rear jet means 110, 120 through the pressurized water supply pipe 220, and is jetted from the intermittent jet heads 150 of the bottom, front and rear jet means 100, 110, 120 with a strong jet pressure in accordance with the operation of the power switch 91, the timer switch 92, the water pressure switch 93 and the ultraviolet sterilization lamp switch 95 of the operation panel 90.

When the water flows through the inlet hole 158 formed at the circumferences of the cylinder unit 151, because the shutter plate 154 periodically opens and shuts the nozzles 156 of the nozzle cover 157 while the impeller 155 installed at the cylinder unit 151 rotates by the influx of the water, the intermittent jet head 150 jets water currents intermittently, and accordingly a massage effect can be maximized by stimulating generally and evenly the soles of the feet, the top sides of the feet and the ankles, etc. with the water currents jetted with the strong jet pressure.

And, the user can add salt or various medicines through the input tube 170 as occasion demands in use of the foot massage apparatus, can use hot water by heating the water to a certain temperature, can use cool water by inserting ice into the input tube 170, and accordingly it is possible to perform efficiently various massages such as a cool or hot water massage, a salt massage, a liquid medicine massage, etc., and have an acupressure effect by using the acupressure roller 60.

As described above, the water currents jetted from the intermittent jet heads 150 of the bottom, front and rear jet means 100, 110, 120 generally and evenly beat the feet, then the water drip down the lower portion of the upper casing 10, gather together at the drain-outlet 14 along the inner bottom surface of the upper casing 10, is filtered by the mesh screen 15, flows into the detachable water vessel 130, and circulates and is jetted repeatedly.

And, when pressurized air is provided from the intermittent pressure means 240 to the plurality of intermittent acupressure means 230 combined with the bottom and front jet means 110, 120 while a massage is performed by jetting water through the intermittent jet heads 150 of the bottom, front and rear jet means 100, 110, 120, the multistage telescoping tube 232 and the acupressure rod 233 combined with the cylinder open portion of the pressure passage 231 which are pressed as depicted in FIG. 13*b* are extended out by the elasticity of the elasticity restoring means 236 as depicted in FIG. 13*a*. As the acupressure rod 233 is repeatedly pressed and extended in accordance with the periodic opening and shutting of the pressure air by the intermittent valve 241 of the intermittent pressure means 240, the rubber cap 234 installed at the upper end of each acupressure rod 233 lightly beats the soles and tops of the feet, and accordingly, the user can have the acupressure effect by the plurality of acupressure rods 233.

When the feet massage ends in accordance with the above-mentioned operation, the operation of the pump 200 and the ultraviolet sterilization lamp 225, etc. is stopped, and the hot air is generated by operating the blower 191 and the ceramic heater 192 of the hot-air drying means 190 in order to dry the wet feet, and thereafter the user pulls out the feet after the feet are dried and cuts off the power by pressing the power switch 91.

In order to clean the inside of the main body after using the foot massage apparatus, the user fills clean water into the detachable water vessel 130, covers the pair of foot insertion holes 13 with the pair of rubber lids 17 and operates the foot massage apparatus.

In addition, since the main body is divided into the upper casing 10 and the lower casing 20, and the casing cover 18 combined with the upper casing 10 is removable, the user can clean every nook and corner of the main body by opening the casing cover 18.

INDUSTRIAL APPLICABILITY

As described above, a foot massage apparatus in accordance with the present invention is sanitary because a user can clean every nook and corner of the foot massage apparatus.

In addition, the foot massage apparatus can perfectly shut off strongly jetted water by installing a contact rubber for fixing an ankle, because the contact rubber has a characteristic of rubber and adopts a slide method or a fastening method fixing a foot according to the size of the ankle by including a contact portion and a pleated portion, the contact rubber is smooth to the touch and is adjustable for all different sizes of ankle, because a limit switch operating by a movable contact rubber is installed to a upper casing, the foot massage apparatus can prevent the water from leaking outwardly due to a wrong operation.

In addition, because a pair of rubber lids for covering a pair of foot insertion holes of the casing cover is combined in cleaning of the foot massage apparatus with clean water there is no need to worry about leakage of the water and it is possible to prevent impurities from entering into the main body in long safekeeping by covering with the rubber covers.

The foot massage apparatus includes a jet head having a jet nozzle separately installed at the front surface, the rear surface and the bottom surface. The nozzle of each jet head is formed as not a shower type but with three holes in order to jet the water very strongly, the water currents jetted from the three jet nozzles are shut and opened by turns in accordance with a rotation of an impeller installed inside the jet head in an intermittent effect. The intermitted water currents are jetted to the feet, and accordingly a massage effect can be maximized by beating and stimulating the feet.

The jet head is installed at 40 portions in order to jet the strongest water currents with the same water pressure, and three nozzle holes are formed at each jet head, so a total of 102 water currents massage the feet by beating the whole feet strongly and intermittently, and accordingly the massage effect can be maximized in a very short time.

The water supplied from the detachable water vessel and passed through a heating unit flows into a pump, the pumped water directly flows into the jet heads placed evenly at the bottom surface, the front surface and the rear surface of the main body. The impeller of each jet head rotates by a jet pressure of the water. The water is jetted intermittently and massages by beating the whole feet while a shutter plate of the impeller periodically opens and shuts the nozzle hole formed at the nozzle cover. Herein, because the water is jetted through a minimum volume of a pressure water chamber formed with only a passage of the water through a bottom jet means, a front jet means and a rear jet means in order to have a more strong and a constant pressure, the water current is stronger as a pressure of the water increases, and the same water current can be maintained by directly connecting each nozzle to the same minimum volume of the pressure water chamber.

A footstool is installed at a portion where the water pressure is maximized from the nozzles, and an acupressure roller is installed at the center portion of the footstool. And, because an input tube is installed at a certain side of the main body, ice, salt, and various medicines filled in the input tube dissolve in water contained in the water vessel installed at the lower casing of the main body, and accordingly it is possible to perform acupressure with the acupressure roller and perform various massagess such as a cool-hot water massage, a salt massage, a medicine massage, etc.

When the jet heads are placed along acupressure points of feet (i.e., a passage for circulating energy and blood up and down and branches divided from the passage in a network in order to circulate energy and blood every nook and corner) as in oriental medicine, an acupressure massage effect is added.

Because an intermittent acupressure means having a plurality of acupressure rods is separately installed at the bottom, the front and the rear surface jet means, it is possible to perform acupressure by using each acupressure rod intermittently, and accordingly the acupressure effect is increased double.

Because the inner bottom surface of the main body slopes upward, the strongly jetted water flows into the detachable water vessel at the lower casing of the main body through a drain-outlet installed at the rear of the bottom surface, and flows into the detachable water vessel after being filtered through a mesh screen combined with the drain-outlet. Herein, because the mesh screen is removable, it is easy to clean.

In addition, because the detachable water vessel can be easily separated from the main body, it is easy to clean and there is no need to move the main body near to a water supply, and because there are graduations on the detachable water vessel, the water can be easily and accurately filled into the detachable water vessel.

An ultraviolet lamp is installed at the upper portion of the detachable water vessel in order to sterilize the water inside the detachable water vessel, and accordingly it is possible to perform a sanitary massage. When the user inserts the detachable water vessel inside the lower portion of the main body, when a discharge pipe of the detachable water vessel is connected with a water supply pipe of a pump, a valve installed at the discharge pipe of the detachable water vessel is opened, When the user pulls the detachable water vessel outwardly, the valve is shut, and accordingly it is easy to handle.

Because the mesh screen is combined with the discharge pipe of the detachable water vessel, it is possible to perform a massage with clean water. When a double filtering method is adopted such as installing a mesh screen also between the discharge pipe of the detachable water vessel and the water supply pipe of the pump, it is possible to perform a massage with cleaner water and can prevent more surely impurities from penetrating into a pump motor.

A heater of a heating means is installed at the center portion of the pump in order to heat the water to a certain degree. The heating means can be used safely by increasing a life span and decreasing a hazard such as an electric leakage, etc. due to the water by building the heater inside a circular pipe (i.e., a cylindrical pipe made of aluminum), and because the inner circumference portion of the circular pipe which is a passage for the water is formed with an uneven shape, the heating efficiency can be maximized.

Because the rear portion of the lower casing is hinge-combined with the upper casing, the front portion of the upper casing can be lifted by being separated from the lower casing, so the user can use the foot massage apparatus at the easiest angle for the convenience of the user by adjusting the angle of the upper casing at a certain degree.

An aromatic agent jet means is combined with the casing cover, accordingly it is possible to jet an aromatic agent inside the main body during a massage.

A hot-air drying means is installed inside the main body. Accordingly it is possible to dry the wet feet easily after the massage.

What is claimed is:

1. In a foot massage apparatus massaging feet by inserting feet inside a main body having a upper casing and a lower casing, putting the feet on a footstool and jetting water from jet means installed inside the main body, an improvement in the jet means, comprising:

a plurality of intermittence jet heads for massaging feet by jetting intermittently pressurized water current, the intermittence jet head including;

a cylinder unit having an axial protrusion formed at the center portion and a pair of inlet holes formed at a peripheral wall for flowing pressurized water;

an impeller installed at the axial protrusion of the cylinder unit and having a plurality of blades at the outer circumference of a hub as a vortex shape and a shutter plate formed at the upper portion in order to cover the part of the plurality of blades; and a nozzle cover combined with the cylinder unit with a screw and having a plurality of nozzles opened and closed by the shutter plate;

said jet means further including;

a bottom jet means installed at the inner bottom surface of the upper casing of the main body and including a plurality of cylinder-shaped recesses within a pair of virtual foot installation regions on the inner bottom surface of the upper casing, an intermittence jet head installed at each cylinder-shaped recess and a pressure water supply pipe connected to a pressure water chamber formed at the inner lower portion of the upper casing;

a front jet means installed at the front of an inner upper surface of the upper casing of the main body and including an intermittence jet head combined with the upper end of a jet pipe connected to the pressure water supply pipe;

a rear jet means installed at the rear of the inner upper casing of the main body and including an intermittence jet head combined with the upper end of the jet pipe connected to the pressure water supply pipe;

wherein the main body comprises;

a casing cover covering the upper casing which is hinge-combined with the lower casing so as to be rotatable; and an angle adjusting means adjusting an angle of the upper casing and having a fixation pipe fixed to the front end portion of a upper plate of the lower casing, an adjusting rod inserted inside the fixation pipe with a spring and having a hemisphere shaped upper end, a seat unit formed at the bottom front end of the upper casing and contact-supporting the adjusting rod and a set screw combined with the upper end of the fixation pipe.

2. The apparatus of claim 1, wherein the main body comprises:

a footstool installed at a bottom surface of the upper casing at a distance from the jet head of the bottom jet means in order to put feet thereon;

a pair of roller supporting plates formed at a bottom center portion of the upper casing;

an axial rod fixed to the pair of roller supporting plates; and acupressure rollers separately combined with the both ends of the axial rod.

3. The apparatus of claim 1, wherein a hot-air drying means is combined with the upper casing.

4. The apparatus of claim 1, wherein an aromatic agent jet means is combined with the upper casing.

5. The apparatus of claim 1, wherein a detachable water vessel is insertable into an open portion of the lower casing, and a switch valve is combined with a discharge pipe of the detachable water vessel which is inserted into a water supply pipe of a pump.

6. The apparatus of claim 1, wherein a rubber cover is combined with an insertion portion formed in an upper surface plate of the casing cover, and an insertion groove in which oval ribs of a fixation contact rubber and a movable contact rubber are inserted is formed in the rubber cover in order to insert there into.

7. The apparatus of claim 1, wherein the jet heads of the bottom jet means are placed within the pair of virtual foot installation regions along acupressure points of the feet as in oriental medicine.

8. The apparatus of claim 1, further comprising:

an input pipe installed at a side of the main body in order to deposit ice, salt, various medicines into a detachable water vessel combined with the lower casing;

a drain-outlet installed at the bottom surface of the upper casing in order to discharge water to the detachable water vessel; and a screening net installed at the drain-outlet.

9. The apparatus of claim 1, further comprising:

a foot insertion hole sealing means separately combined with a pair of foot insertion holes formed in the casing cover including;

a fixation contact rubber having a contact portion formed at an inner circumference of an oval rib and a fixation portion formed at an outer circumference of the oval rib and fixed at a side of each foot insertion hole by inserting the fixation portion into a fitting unit formed at a back surface of the upper surface plate of the casing cover, a movable contact rubber having an oval fitting unit at a side of a plate installed at the upper surface of the upper casing, a contact portion formed at an inner circumference of an oval rib and a fixation portion formed at an outer circumference of the oval rib and fixed by inserting the fixation portion into the oval fitting unit, and a guide formed at a back surface of the upper plate of the casing cover in order to guide the plate so as to be slide-movable.

10. The apparatus of claim 9, wherein a limit switch is installed at the back surface of the upper plate of the casing cover and operates when the movable contact rubber contacts to an ankle of a user.

11. The apparatus of claim 1, wherein the bottom and front jet means each comprises bottom and front intermittent acupressure means and wherein the intermittent acupressure means is installed at the bottom jet means within the pair of virtual foot installation regions and the front intermittent acupressure means is installed at the front jet means so as to be placed adjacent to the jet head of the front jet means in order to perform acupressure intermittently with an acupressure rod.

12. The apparatus of claim 11, wherein the intermittent acupressure means comprises:

a multistage telescoping tube inserted into a circular open portion of a pressure passage with the acupressure rod;

a rubber cap combined with the upper end of the acupressure rod; and an intermittent valve connected to the pressure passage through a pipe.

* * * * *